United States Patent [19]

Naito

[11] 3,978,649

[45] Sept. 7, 1976

[54] QUARTZ CRYSTAL ELECTRONIC TIMEPIECE

[75] Inventor: Okito Naito, Suwa, Japan

[73] Assignee: Kabushiki Kaisha Suwa Seikosha, Tokyo, Japan

[22] Filed: July 22, 1974

[21] Appl. No.: 490,550

[30] Foreign Application Priority Data

July 20, 1973 Japan ..... 48-80583

[52] U.S. Cl. ..... 58/23 R; 58/85.5

[51] Int. Cl.[2] ..... G04C 3/00

[58] Field of Search ..... 58/23 R, 50 R, 85.5, 58/4 A

[56] References Cited

UNITED STATES PATENTS

| | | | |
|---|---|---|---|
| 3,530,663 | 9/1970 | Marti | 58/23 R |
| 3,540,207 | 11/1970 | Keeler | 58/23 R |
| 3,541,779 | 11/1970 | Langley | 58/23 R X |
| 3,629,582 | 12/1971 | Koehler | 58/23 R X |
| 3,777,471 | 12/1973 | Koehler et al. | 58/85.5 X |
| 3,812,669 | 5/1974 | Wiget | 58/23 R |
| 3,812,670 | 5/1974 | Nikaido et al. | 58/23 R |

*Primary Examiner*—Ulysses Weldon

*Attorney, Agent, or Firm*—Blum, Moscovitz, Friedman & Kaplan

[57] ABSTRACT

An electronic timepiece having a quartz crystal oscillator circuit adapted to be tuned to a reference frequency or a reference frequency minus *m*Hz, where *m* is an integer and a divider circuit adapted to produce a predetermined timekeeping signal is provided. The divider circuit includes a plurality of divider stages, the number of divider stages determining a division ratio to produce the predetermined low frequency signal in response to the high frequency reference signal. An adjustment circuit is coupled to the divider circuit, the adjustment circuit being adapted to adjust the division ratio of the plurality of divider stages to thereby generate the predetermined frequency when the oscillator circuit is tuned to the high frequency reference signal minus *m*Hz.

9 Claims, 4 Drawing Figures

QUARTZ CRYSTAL ELECTRONIC TIMEPIECE

BACKGROUND OF THE INVENTION

This invention is directed to a quartz crystal electronic timepiece and in particular to an electronic timepiece adapted to produce a low frequency timekeeping signal of a predetermined frequency in response to one of several high frequency standard signals produced by an oscillator circuit.

The use of quartz crystal vibrators in electronic timepieces has gained wide popularity because quartz crystal oscillator crystals utilizing such vibrators provide a highly stabilized high frequency output. Nevertheless, because such circuits have a high Q, the half-width $\Delta f$ of the gain, wherein the gain of the vibrator comes down to $1/\sqrt{2}$ represents a very narrow range since $\Delta f = f/Q$. Accordingly, the range of frequencies over which quartz crystal oscillator circuits can produce a stable reference frequency and the amount of deviation from the center frequency $f_o$ which can be tolerated, are extremely limited, if the accuracy of the electronic timepiece is to be maintained.

Also, because the number of divider stages is selected in order to divide the center frequency $f_o$ to a predetermined frequency, such divider circuits are not capable of providing a timekeeping signal of a predetermined frequency when the center frequency of the oscillator circuit deviates from the reference frequency. Accordingly, it is necessary to manufacture the quartz crystal vibrator and circuit incorporating same with extreme accuracy, thereby rendering mass production of integrated circuit electronic timepieces utilizing such vibrators cumbersome hence increasing the cost of manufacturing same.

SUMMARY OF THE INVENTION

Generally speaking, in accordance with the invention, an electronic timepiece includes a divider circuit and a quartz crystal oscillator circuit adapted to be tuned to either a high frequency reference signal or a high frequency reference signal minus $m$ Hz where $m$ is an integer. The divider circuit includes a plurality of divider stages, the number of divider stages determining the division ratio to thereby produce said predetermined low frequency signal in response to said high frequency reference signal. A display for displaying the predetermined timekeeping signal is provided. An adjustment circuit is coupled to the divider circuit, the adjustment circuit being adapted to adjust the division ratio of the plurality of divider stages to thereby generate the timekeeping signal at the predetermined low frequency when the oscillator circuit is tuned to the high frequency reference signal minus $m$.

Accordingly, it is an object of this invention to provide a low cost electronic timepiece particularly suited to be manufactured by mass production techniques.

Another object of this invention is to provide an electronic timepiece adapted to provide accurate timekeeping signals in response to a range of reference frequencies produced by the oscillator circuit thereof.

Still another object of this invention is to provide an improved integrated circuitry electronic timepiece at minimum expense by allowing the oscillator circuit to be mass produced.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
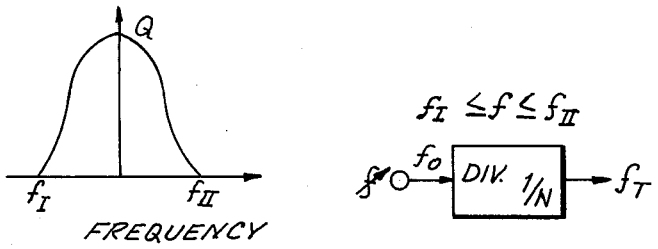
FIG. 1 PRIOR ART
FIG. 1 is a graphical representation of a reference frequency and a divider circuit for dividing same constructed in accordance with the prior art.

Reference is now made to FIG. 1 wherein a high frequency signal produced by a quartz crystal oscillator circuit constructed in accordance with the prior art, and a divider circuit for dividing same is depicted. In order to obtain a predetermined low frequency timekeeping signal, the frequency of the quartz crystal vibrator must by preadjusted to a variable range of $f_I \leq f \leq f_{II}$ at the time that the quartz crystal vibrator is manufactured. Such adjustment is achieved by varying the capacitive and other circuit elements utilized in the oscillating circuit. It is essential that the frequency of the oscillating circuit be adjusted to the center frequency $f_o$ by means of a circuit design so that the frequency thereof is divisible by the division ratio N of the divider circuit to thereby produce a predetermined low frequency timekeeping signal $f_T$. Since the range over which the reference frequency can vary is small, $\Delta f \leq f_N - f_I$, considerable time and cost is required to insure that the oscillator circuit is designed within the required range thereby rendering same not particularly suited for modern mass production techniques.

Figure 2:
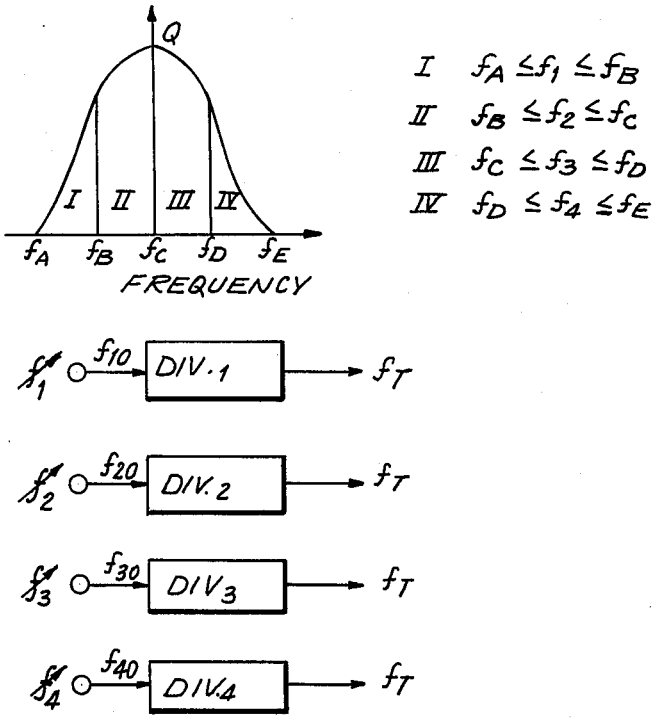
FIG. 2 is a graphical representation of a plurality of reference and divider circuits for dividing same constructed in accordance with the instant invention.

Reference is now made to FIG. 2, wherein the underlying concept of the instant invention, a concept which enables a quartz vibrator to be mass produced and particularly suited for use in an electronic timepiece, is depicted. As is specifically illustrated therein the width $f_E - f_A$ over which the frequency of the quartz crystal oscillators can vary when manufactured within a range four times as wide as the prior art control range $f_{II} - f_I$. Heretofore, in order for the electronic timepiece having a quartz crystal oscillator circuit to obtain the predetermined low frequency signal $f_T$ for display, the quartz crystal vibrator had to be manufactured so that it had a frequency $f$ ($f_I \leq f \leq f_{II}$) to render same divisible by a divider circuit having a single division ratio. In order to overcome this disadvantage, the instant invention provides the predetermined low frequency time-keeping signal $f_T$ to be supplied to the display by allowing the oscillator circuit to be tuned to one of several frequencies within a particular range and by further providing circuitry adjusting the division ratio of the divider stages in order to guarantee the predetermined timekeeping signal is supplied to the display device. Accordingly, the output of the oscillator circuit can be classified into a plurality of groups. As is illustrated in FIG. 2, four groups namely, $$f_A \leq f_1 \leq f_B \leq f_H \leq f_2 \leq f_C \leq f_C \leq f_3 \leq f_D \leq \text{ and } f_D \leq f_4 \leq f_E,$$

to which it is necessary to provide four frequency divider circuits $DIV_1$, through $DIV_4$ having four respective division ratios. Because the range over which the frequency in each group is limited, by the same restriction which limits the conventional control range, namely, $f_H - f_I = f_B - f_A = f_C - f_B = f_D - f_C = f_e - f_D$, it is easy to tune an oscillator circuit within those ranges. Nevertheless, a separate divider circuit having the proper division ratio would have to be provided in order to obtain such an output. Accordingly, once it is determined which of the center frequencies $f_{10}$ through $f_{40}$ the oscillator circuit can be tuned to, then the oscillator circuit can be utilized with a divider circuit particularly suited therefor and such matching lends itself to mass production techniques. Nevertheless, if a frequency divider circuit can be provided which is adapted to have the division ratio thereof adjusted to deal with the different numbers of frequencies to which the oscillator circuit can be tuned, then an electronic timepiece becomes particularly suited for modern mass production techniques. Accordingly, a frequency divider circuit adapted to achieve a change of division ratio in response to a certain group of frequencies at which the oscillator circuit can be tuned is provided by the instant invention, as is hereinafter discussed.

Figure 3:
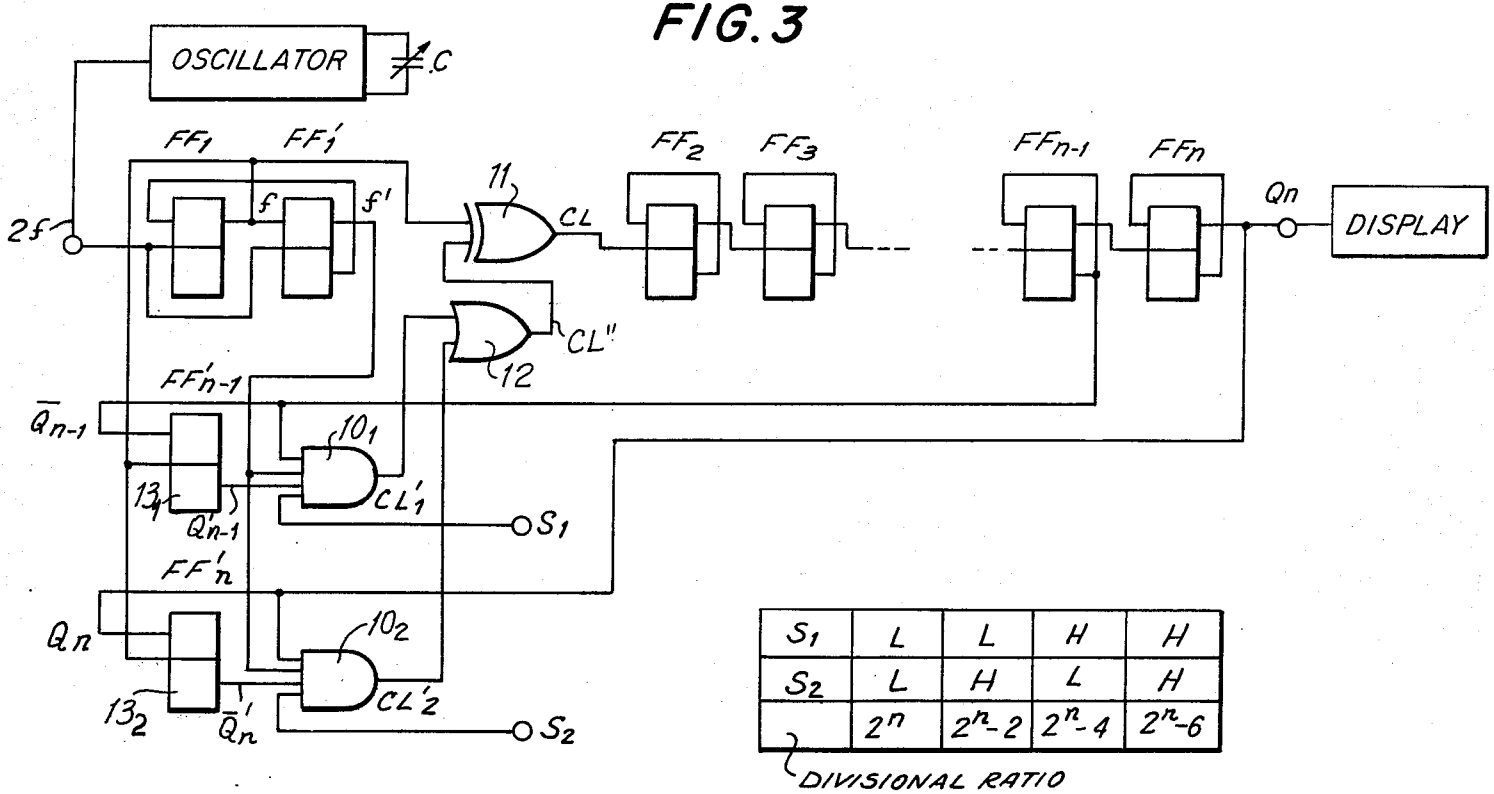
FIG. 3 is a circuit diagram of a divider circuit and adjustment circuit for use in a electronic timepiece constructed in accordance with the instant invention.

Reference is now made to FIG. 3, wherein a frequency divider circuit, constructed in accordance with the instant invention, is depicted. An oscillator circuit provided with means C for tuning the frequency thereof within a predetermined range produces a high frequency reference signal $2f$ where $2f$ is one of the center frequencies $f_{10}$ through $f_{40}$ discussed in connection with FIG. 2. Any known tunable oscillator can be used such as the oscillator depicted in U.S. Pat. No. 3,728,641 issued on Apr. 17, 1973. The divider circuit includes a plurality of divider stages $FF_1$, $FF'_1$, $FF_2$ . . ., $FF_{n-1}$, $FF_n$, which divider stages are adapted to be one-half counters in the embodiment depicted. Accordingly, a predetermined low frequency timekeeping signal $Q_n$ is obtained from a high frequency reference signal $2f$, the number of divider stages providing a division ratio of $1/2^n$. Control terminals $S_1$ and $S_2$ are provided as inputs to an adjusting circuit which includes as operative elements, AND gates $\mathbf{10_1}$ and $\mathbf{10_2}$, EXCLUSIVE OR gate 11, OR gate 12 and delay flip-flops $\mathbf{13_1}$ and $\mathbf{13_2}$, the operative elements being adapted to adjust the division ratio to produce a predetermined timekeeping signal in response to one of the reference frequencies within the range indicated in the table of FIG. 3.

Figure 4:
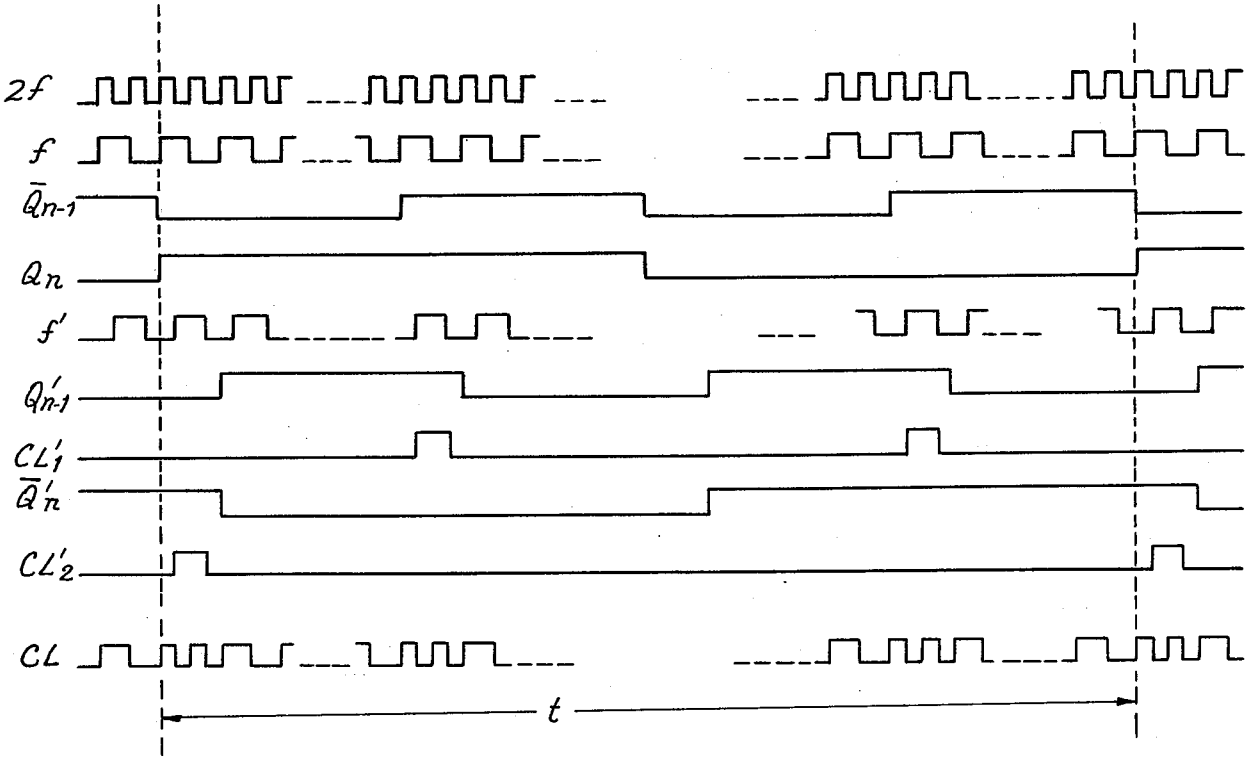
FIG. 4 is a wave diagram of the timing sequence of the circuit illustrated in FIG. 3 in operation.

Reference is made to FIG. 4, wherein waveform diagrams for the circuit illustrated in FIG. 3 is depicted, for the case where $S_1$ and $S_2$ are both at a high potential (when control signals are applied thereto), the manner in which the division ratio is effected being demonstrated thereby. AND gates $\mathbf{10_1}$ and $\mathbf{10_2}$ have first inputs respectively referenced to control terminals $S_1$ and $S_2$. Each AND gate further includes as a second input a signal $f'$ from flip-flop $FF_1'$ which signal has the same frequency as the output of flip-flop $FF_1$ with a delay of one quarter cycle. Additionally, AND circuit $\mathbf{10_1}$ has two further inputs applied thereto. The first is signal $\overline{Q}_{n-1}$ which signal is the complement of the output signal from the next to last divider stage $FF_{n-1}$. The other input thereto is a signal $\overline{Q'}_{n-1}$ which is a signal having the same frequency as the output from $FF_{n-1}$, the delay flip-flop $\mathbf{13_1}$, delaying same by a period equal to the signal $f$. Accordingly, if each of the inputs to AND gate $\mathbf{10_1}$ is positive, the AND gate will produce a positive pulse $CL_1'$, having a duration equal to the time that all the signals applied thereto are positive. Accordingly, as soon as any of the signals applied thereto becomes negative the output $CL_1'$ of the AND gate $\mathbf{10_1}$ becomes zero.

Referring to gate $\mathbf{10_2}$, the other two input signals not in common with AND gate $\mathbf{10_1}$ are the output Qn of the last frequency divider stage $FF_n$ and the output $Q_n'$ of delay flip-flop $\mathbf{13_2}$, which signal has the same frequency as $Q_n$ but is delayed by the period equal to $f$ by delay flip-flop $\mathbf{13_2}$. The outputs of the two AND gates $\mathbf{10_1}$ and $\mathbf{10_2}$ are applied as inputs to OR gate 12 and in response to a positive input by either one of the AND gates or both of the AND gates, a positive pulse is applied to the EXCLUSIVE OR gate 11. The EXCUSIVE OR gate 11 has as its other input the output frequency from the next previous divider stage $FF_1$. Accordingly, the EXCLUSIVE OR gate compares the output pulse CL'' from the OR gate 12, and the frequency $f$ from $FF_1$ and for each positive excursion thereof produces a one to the next divider stage $FF_2$ unless both inputs are one or zero, in which event, the output thereof is zero. As is clearly illustrated in FIG. 4, the signal CL applied to the next divider stage $FF_2$ in response to high potential signals being applied to control terminals $S_1$ and $S_2$ is the addition of three pulses for each period t of the divider stage $FF_n$, the addition of the three pulses to the input of the divider stage $FF_2$ providing a division ratio of $2^n - 6$. Accordingly, a quartz crystal oscillator circuit need only be tuned to one of four frequencies to thereby allow a greater tolerance when same is constructed.

For example, if the reference frequency $2f$ is selected as 32,768 Hz, $n = 15$ and to obtain a one second timekeeping signal, it only required to tune the center frequencies of the quartz crystal oscillator circuit to the reference frequency 32,768 Hz or a reference frequency minus $m$ Hz, such as 32,766 Hz, 32,765 Hz or 32,762 Hz, and then to set the division ratio of the divider circuit by the application of high potential signals to control terminals $S_1$ and $S_2$. It is appreciated that the range over which the quartz crystal oscillator circuit is adjustable is approximately five seconds per day. Furthermore, where it is required to control the frequency within 2 Hz or less from 32,768 Hz, it is then only necesary to control the frequency within 8 Hz or less, namely, within a range of about 21 seconds converted to a daily rate if the quartz crystal oscillator circuit is capable of being tuned to one of the stable frequencies. Accordingly an electronic timepiece utilizing such a quartz crystal vibrator and divider circuit admits of easy construction by mass production techniques. Moreover, since an electronic timepiece formed in the above described manner is regulated in accordance with the frequency of the quartz crystal oscillator circuit and the manner in which same is tuned, it is only necessary to vary the capacitive element or the like, and therefore renders unnecessary the design restrictions of the timepiece movement due to the limited space.

It is further noted that the range over which the frequency of a quartz crystal vibrator may be utilized is four times wider than the range in the case where the conventional dividers provide a single division ratio. Of course, by utilizing further AND gates and other combinations of input signal, and further by positioning an EXCLUSIVE OR gate between different divider stages, the number of pulses to be added during each period can be increased, thereby increasing the range over which the oscillator circuit can be produced.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic timepiece comprising oscillator means for producing a high frequency reference signal, said oscillator means including one of a plurality of quartz crystal vibrators each capable of vibrating at a different frequency, said oscillator means being tunable to vibrate at a predetermined high frequency selected from a group including a desired high frequency and at least one high frequency which varies from said desired high frequency by *m* Hz, where *m* is an integer, as determined by the one of said plurality of vibrators included therein; divider means including a plurality of series-connected divider stages adapted to produce a predetermined low frequency signal, the number of divider stages determining a division ratio for producing said predetermined low frequency signal in response to the application thereto of a high frequency reference signal of said desired frequency from said oscillator means; and adjustment means coupled to said divider means, said adjustment means being adapted to selectively adjust the division ratio of said divider means to thereby produce said predetermined low frequency signal when said oscillator means produces a high frequency reference signal which varies from said desired high frequency by *m* Hz.

2. An electronic timepiece as recited in claim 1 wherein said oscillator means includes means for selectively tuning the frequency of the high frequency standard signal to one of the desired high frequency and a high frequency which varies from said desired high frequency by *m* Hz.

3. An electronic timepiece as recited in claim 1 wherein said adjustment means is adapted to produce a selected number of adjustment pulses during each period of said predetermined low frequency signal, said adjustment means including combining circuit means in series-connection between one of said divider stages and the next-previous divider stage for receiving a pulse signal from said next-previous divider stage and said adjustment pulses and in response thereto supplying a combined adjustment pulse signal to said one divider stage, said combined adjustment signal including an excursion corresponding to each excursion of said next-previous divider stage signal and at least one excursion for each excursion of said adjustment pulses.

4. An electronic timepiece as claimed in claim 3, wherein said adjustment means includes first circuit means for producing said adjustment pulses applied to said combining circuit means, each of said adjustment pulses having a period equal to the period of the next-previous divider stage signal delayed by a time equal to one-half the period of the next previous divider stage signal.

5. An electronic timepiece as claimed in claim 3, wherein said combining circuit means is an EXCLUSIVE OR gate.

6. An electronic timepiece as claimed in claim 4, wherein said first circuit means includes second circuit means for providing a signal which is the complement of said predetermined low frequency signal delayed by one-half the period of said next previous divider stage signal, and third circuit means for providing a signal having the same period as the next previous divider stage signal and delayed by a time equal to one-quarter the period thereof, and a gating means intermediate said second and third circuit means, for producing said adjustment pulses in response to a coincident application of said predetermined low frequency signal, said signal which is the complement of said predetermined low frequency signal delayed by one-half the period of said next previous divider stage signal, and said next previous divider stage signal delayed by a time equal to one-quarter the period thereof.

7. An electronic timepiece as claimed in claim 6, wherein said gating means includes a delay flip-flop adapted to receive said predetermined low frequency signal and said next-previous divider stage signal, and in response therto to provide a signal which is the complement of said predetermined low frequency signal delayed by a time equal to one half of the next previous divider stage signal, and AND gate means for receiving said complementary delayed predetermined frequency signal and said predetermined low frequency signal and reference frequency signal delayed by one-quarter cycle, the output of said AND gate being supplied to said combining circuit means as said adjustment pulses.

8. An electronic timepiece as claimed in claim 7, wherein said AND gate means includes a control input, said control input being referenced to one of a first and second potentials, said first and second potentials respectively determining the presence or absence of an adjustment pulse applied to said EXCLUSIVE OR gate.

9. An electronic timepiece as claimed in claim 8, and including fourth circuit means for providing a signal which is the complement of the next to last divider stage signal and further gating means including a further delay flip-flop adapted to receive as a first input the complement of said next to last divider stage signal and said next-previous divider stage signal, and in response thereto produce a signal having the same frequency as said next to last divider stage signal delayed by a time equal to one-half of the period of the next previous divider stage signal, further AND gate means including a control input, said control input being referenced to one of a first and second potentials, said first and second potentials respectively determining the presence or absence of an an adjustment pulse produced by said further AND gate means, said further AND gate means being adapted to receive said next to last divider stage signal delayed by a time equal to one-half the period of the next-previous divider stage signal, the complement of the next to last divider stage signal, the next-previous divider stage signal delayed by a time equal to one-quarter the period of the next previous divider stage signal, and in response to the application of said signals thereto and said control input being referenced to said first potential, producing adjustment pulses, and an OR gate adapted to receive said adjustment pulses from said AND gate means and said further AND gate means and in response thereto supply said adjustment pulses to said combining circuit means.

* * * * *